US008156771B2

(12) United States Patent
Kostal et al.

(10) Patent No.: US 8,156,771 B2
(45) Date of Patent: Apr. 17, 2012

(54) DISPOSABLE HANDCUFFS

(76) Inventors: Bretislav Kostal, Prague (CZ); Vladimir Kupa, Prague (CZ)

( * ) Notice: Subject to any disclaimer, the term of this patent is extended or adjusted under 35 U.S.C. 154(b) by 137 days.

(21) Appl. No.: 12/660,355

(22) Filed: Feb. 25, 2010

(65) Prior Publication Data

US 2010/0229350 A1 Sep. 16, 2010

(30) Foreign Application Priority Data

Mar. 11, 2009 (CZ) ..... 2009-154

(51) Int. Cl.
*E05B 75/00* (2006.01)

(52) U.S. Cl. ..... 70/16; 24/16 PB; 128/878

(58) Field of Classification Search ..... 70/15–18, 70/386; 24/16 PB, 25, 115 L, 115 M, 136 A, 24/181, 188; 128/878, 879
See application file for complete search history.

(56) References Cited

U.S. PATENT DOCUMENTS

| | | | | | |
|---|---|---|---|---|---|
| 296,686 | A | * | 4/1884 | Gresham | 24/25 |
| 539,650 | A | * | 5/1895 | Searle | 70/16 |
| 4,854,138 | A | * | 8/1989 | Charland | 70/16 |
| 4,909,051 | A | * | 3/1990 | Lee | 70/16 |
| 4,964,419 | A | | 10/1990 | Karriker | |
| 5,088,158 | A | * | 2/1992 | Burkholder | 24/16 PB |
| 5,092,641 | A | * | 3/1992 | Penick, Jr. | 292/307 R |
| 5,147,145 | A | * | 9/1992 | Facey et al. | 403/314 |
| 5,170,537 | A | * | 12/1992 | Sperling | 24/136 A |
| 5,230,541 | A | * | 7/1993 | Nowak | 292/288 |
| 5,359,870 | A | * | 11/1994 | Reutlinger | 70/456 R |
| 5,368,278 | A | * | 11/1994 | Kurmis | 254/216 |
| 5,398,383 | A | * | 3/1995 | Bingold | 24/16 PB |
| 5,443,155 | A | * | 8/1995 | Robinson | 206/223 |
| 5,538,300 | A | * | 7/1996 | Brown | 292/307 R |
| 5,669,110 | A | | 9/1997 | Parsons | |
| 5,794,461 | A | * | 8/1998 | Smith | 70/16 |
| 6,101,682 | A | * | 8/2000 | Parsons | 24/16 PB |
| 6,196,033 | B1 | * | 3/2001 | Dowdle | 70/16 |
| 6,199,412 | B1 | * | 3/2001 | Kennedy | 70/18 |
| 6,219,887 | B1 | * | 4/2001 | Parsons | 24/16 PB |
| 7,882,599 | B2 | * | 2/2011 | Harrington | 24/17 AP |
| 2007/0180870 | A1 | * | 8/2007 | DePetrillo | 70/16 |
| 2011/0167880 | A1 | * | 7/2011 | Klementowicz et al. | 70/16 |

FOREIGN PATENT DOCUMENTS

CZ PV 2007-690 4/2009

* cited by examiner

*Primary Examiner* — Lloyd Gall
(74) *Attorney, Agent, or Firm* — Collard & Roe, P.C.

(57) ABSTRACT

Disposable handcuffs include a flat strap of flexible material forming adjustable loops and a box for fixing the central section of the flat strap and provided with passages for receiving the flat strap, each of the passages having a strap supporting wall and an opposite partially offset wall forming a cavity between the walls closed on the side of the box adjacent to the loop and opened on the opposite side of the box. A rotational body is located within each of the cavities for contact of the rotational surface thereof with the offset wall on one side and with the flat strap on the other side, a boss including a sharp end extending from the rotational surface to engage the flat strap in the area of the cavity adjacent to the opposite side of the box.

9 Claims, 2 Drawing Sheets

DISPOSABLE HANDCUFFS

CROSS REFERENCE TO RELATED APPLICATIONS

Applicants claim priority under 35 U.S.C. §119 Czech Republic Application No. PV 2009-154 filed on Mar. 11 , 2009.

FIELD OF INVENTION

The invention relates to disposable handcuffs comprising a flat strap of flexible material including two outer sections, a central section and two loop sections between said outer sections and said central section, a box having a first side and a second side and a pair of passages between them for receiving the flat strap for longitudinal motion thereof within the passages and means for locking the flat strap in the passages, the ends of the outer sections extending from the first side of the box and the loop sections extending from the second side of the box and means for fixing the central section in the box.

DESCRIPTION OF THE PRIOR ART

Disposable handcuffs or keyless handcuffs consisting mostly of a cord or a plastic straps and a locking mechanism are used as an inexpensive substitute for conventional metal restraints with a lock and key. Their use is advantageous in situations where greater number of persons shall be restrained and arrested within relatively short period of time and where the use of conventional handcuffs would be time consuming and expensive. With this type of handcuffs the persons are mostly released by destruction—cutting through the plastic strap or cord by the authorized officer. The most important part of the disposable handcuffs is the locking mechanism, which shall withstand the efforts of the detainee to release himself from the wrist surrounding loops by tampering with the device and using thin objects to damage or eliminate the self locking parts of the mechanism to free the loops.

U.S. Pat. No. 4,964,419 discloses a crimping mechanism of reusable handcuffs with a two-way passage for receiving and crimping a cord forming the loops together with their free end sections. The cord crimping member or jaws are biased to the crimping position by a spring and the crimping member or jaws may be released by pushing down a plunger acting against the force of the spring. Nevertheless, the crimping force exerted on several cord layers may appear to be insufficient and therefore it is recommended to make a knot on the free end cord sections. Moreover, the release plunger, although not directly accessible by the hand of the detainee, involves potential danger in that the detainee may find an instrument for pressing the plunger down and thus to release himself from the handcuffs.

A disposable restraining device is described in U.S. Pat. No. 5,669,110. The device comprises an interlocking cover for joining together two locking boxes each designed to anchor one end of a separate strap. The loops are formed by threading the other ends of the straps through the respective openings in the cover and the locking box. Each strap is secured within the locking box by interaction of a saw tooth ribbed surface of the strap with opposite oriented resilient detents of the locking box. The disclosed locking mechanism requires unconventional specific design of straps in combination with locking boxes what makes the handcuffs expensive and less universal.

The Czech application for invention PV 2007-690 discloses a locking mechanism for each loop consisting of an axially movable wedge shaped body located in a narrowing passage for the loop forming strap. The body is provided with saw teeth on the side adjacent to the strap surface so that when the strap moves again the saw teeth, for example in the effort of a detainee to release the loop, the body moves deeply into the narrowed part of the chamber and the body teeth are pressed down into the strap so that their locking effect is increased. Nevertheless, the locking effect of the saw teeth may be insufficient with straps made of non standard hard materials.

SUMMARY OF THE INVENTION

The object of the invention is to provide disposable handcuffs with a single strap and simple and reliable locking mechanism applicable to all conventional types of straps whether made of solid material or knitted fabrics.

According to the invention the disposable handcuffs comprise a flat strap of flexible material including two outer sections, a central section and two loop sections between said outer sections and said central section, a box for locking the flat strap therein having a first side and a second side and a pair of passages between said sides for receiving the flat strap for longitudinal motion within the passages, the ends of the outer sections extending from the first side of the box and the loop sections extending from the second side of the box and means for fixing the central section in the box. The object of the invention is achieved in that each of the pair of passages have a strap supporting wall and an opposite partially offset wall forming a cavity between said walls open to the first side of the box, a rotational body located within each of the cavities for contact of the rotational surface thereof with the offset wall on one side and the flat strap on the other side, a boss having a sharp end extending s from the rotational body to engage the outer section of the flat strap adjacent to the first side of the box and a cover fixed on the first side of the box and overlapping the cavities.

In order to ensure an immediate locking effect of the rotational body a holding down member is disposed between the rotational body and the cover to keep the sharp end of the boss in contact with the flat strap. Preferably, the holding down member is a roller made of elastic material.

To further enhance the locking effect, the cavity is narrowing from the first side of the box by inclining the offset wall at an angle of 2 to 5 degrees.

According to another aspect of the invention, the box has two central passages in the central part between the pair of passages for fixing the central section of the flat strap in the box.

According to still another feature of the invention the box has a recess in the central part of the first side for fixedly mounting the cover in the box to fix the central section of the flat strap on the box.

To improve the fixing effect of the cover the cover has a central edge and two lateral ledges and the first side of the box has complementary surfaces to crimp the flat strap between the central edge and the lateral ledges of the cover and the first side of the box.

Advantageously, the flat strap is made of a textile material.

The essential feature of the invention resides in the use of a locking rotational body with a boss extending from its rotational surface and provided with a sharp end or tip for engaging the flat strap. In another advantageous embodiment, the rotational body is combined with a holding down member avoiding the lost of contact of the sharp end with the flat strap. In the effort to release the loop surrounding the detainee's wrist by pulling on the strap loops, the sharp edge or tip on the rotational body starts to rotate and to protruding deeper into the flat strap material. Accordingly, a progressive locking effect takes place thereby hindering any other motion of the flat strap which could cause a release of the loop. The use of a tip end increases the pressure exerted on the strap by order of magnitude when compared with wedge or saw teeth and provides the highest security of the device. The box cover provided with central edge and lateral ledges for locking the flat strap obstructs any access to the strap from the other side and further increases the safety of the fixation of the flat strap in the box. A resistant textile material made for example from synthetic knitted fibers used for the flat strap is capable to withstand lateral forces exerted by the sharp edge on the textile material and reduces the handcuffs weight and consequently the danger of using the handcuffs as a striking instrument.

BRIEF DESCRIPTION OF THE DRAWINGS

Further objects of the present invention together with additional features contributing thereto will be apparent from preferred embodiments of the invention as illustrated in the accompanying drawings wherein.

DETAILED DESCRIPTION OF THE PREFERRED EMBODIMENT

Figure 1:
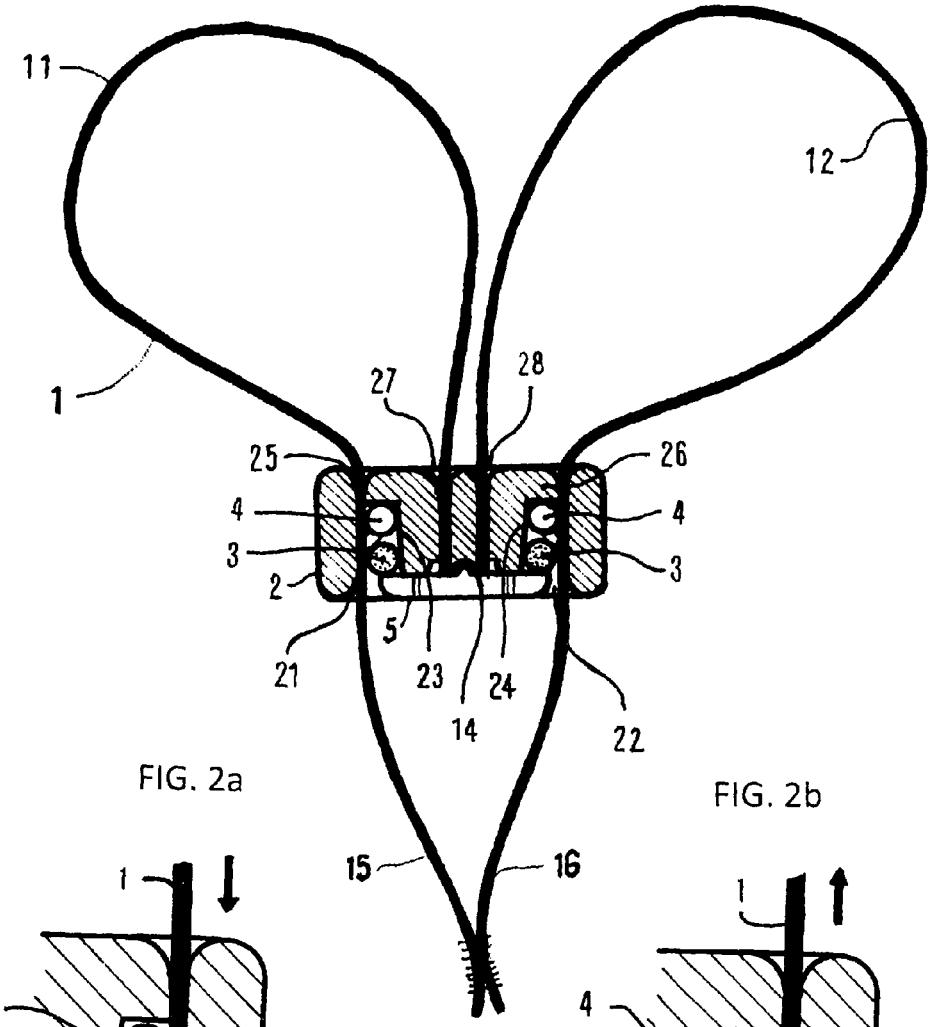
FIG. 1 is an overall sectional view of handcuffs including loops and a locking box.
Figure 3:
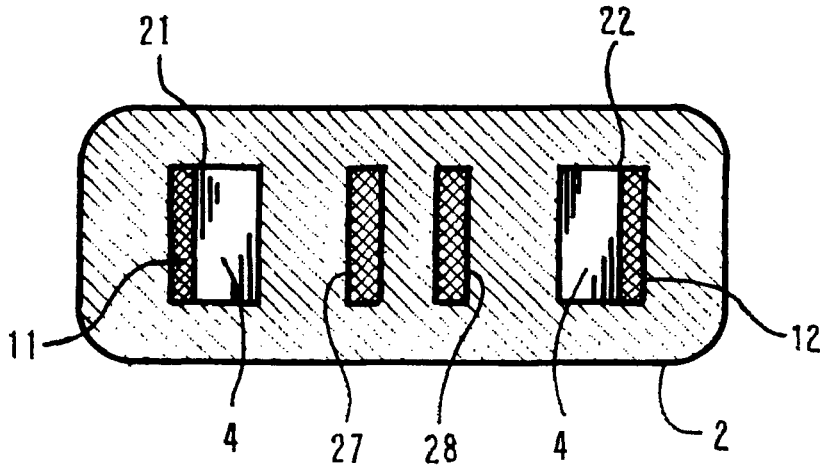
FIG. 3 is a plan sectional view of the box.

Disposable handcuffs shown in an overall configuration in FIG. 1 comprise a flat strap 1 of flexible material, for example of textile made of knitted synthetic fibers, including nylon webbings etc. consisting of a central section 14, loops 11,12 and outer sections 15,16. The central section 14 is embedded in a box 2 for locking the flat strap by treading each of outer sections 15, 16 through central passages 27, 28 in the box 2 and then through the outer passage 21, 22 in the box 2. The outer sections 15, 16 are tied up together under the lower—first side of the body 2. As shown in FIG. 3, all the passages have approximately rectangular, oblong cross-section for receiving the flat strap 1. The passages 21, 22 have a flat strap support wall on one side and an opposite, partially offset wall 23, 24 on the other side forming thereby a cavity closed by shoulders 25, 26 next to the upper—second side of the box 2 and opened on the first side of the box 2. The lower part of the box 2 has a recess for receiving a cover 5 to close up the cavity.

Figure 4:
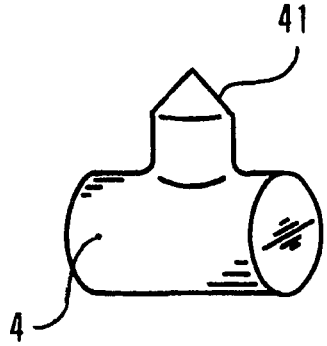
FIG. 4 is an enlarged perspective view of the rotational body.

A rotational body 4 is inserted in each cavity of the passages 21, 22. As shown in detail in FIG. 4, the rotational body 4 is shaped as a roller and is provided with a boss extending from the rotational surface of the rotational body 4 and ending by a sharp end which may have a form of a tip 41. The rotational body 4 is positioned within the cavity so that the tip 41 is directed towards the outer sections 15, 16 of the flat strap. This position of the rotational body 4 enables the outer sections 15, 16 of the flat strap to slide on the tip 41 surface when moving out of the first side of the box 2 (see FIG. 2*a*) but prevents the outer sections 15, 16 to move in the opposite directions out of the second side of the box 2 and thereby to expand the loops 11, 12 (see FIG. 2*b*).

A holding down member 3 is located in the cavity between the cover 5 and the rotational body 4. The holding down member 3 may have a form of a roller or otherwise shaped body, such as a spring etc. Further, the holding down member 3 may be substituted with a projection formed on the respective portions of the cover 5 overlapping the cavities and extending into the cavity. The purpose of the holding down member 3 is to keep the tip 41 in contact with the flat strap 1 to reduce to minimum the path of the tip from its released position into a position where the tip 41 engages firmly the flat strap 1 and protrudes into the surface of the flat strap 1. In the utmost position the tip 41 leans against the strap support wall to obstruct any further motion of the flat strap 1 out of the box 2 and thereby to expand the respective loops 11, 12. In order to increase the force of the rotational body 4 exerted on the flat strap 1 when the rotational body 4 is carried by the flat strap 1 to the shoulder 25, 26, the offset walls of the passages 21, 22 are inclined at an angle of 2 to 5 degrees thereby narrowing the cross section of the cavity towards the shoulders 25, 26.

Figure 5:
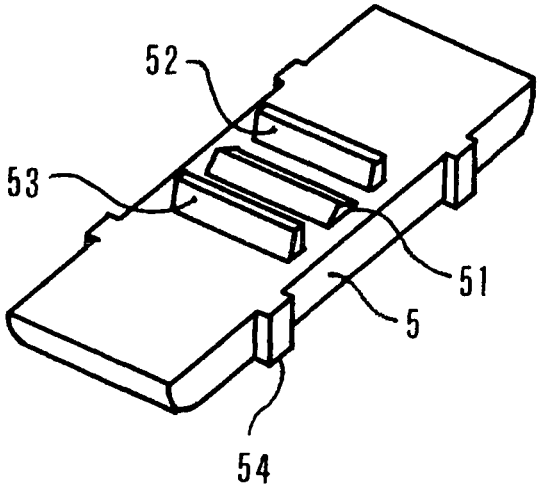
FIG. 5 is a perspective view of a box cover.

As shown in FIG. 5, the cover 5 is in its medium portion provided with a central ledge 51 of triangular cross section and two lateral ledges 52, 53 of trapezoidal cross section, while the box 2 is on the first side provided with complementary recesses situated along the central passages 27, 28. The central section 14 of the flat strap 1 is firmly and unreleasably held in its crimpled position between the ledges 51, 52, 53 and the complementary recesses in the box 2 by pressing down the cover 5 into the box 2. The correct position of the cover 5 with respect to the box 2 is further secured by four lateral guides 54 and corresponding recess in the box 2.

It is obvious that the passages 21, 22 may have a cross section other than a rectangular one and the rotational body 4 may take a shape matching the cross section of the passages 21, 22, for example a barrel shape, etc.

Figure 2A:
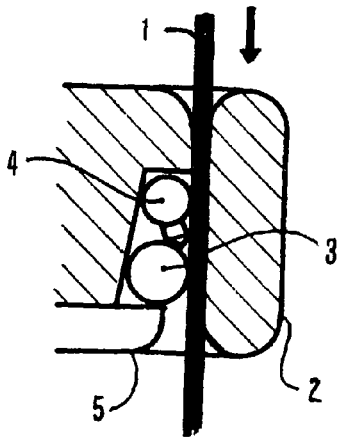
FIG. 2*a* is a detailed sectional view of a locking mechanism in the process of forming the loops.
Figure 2B:
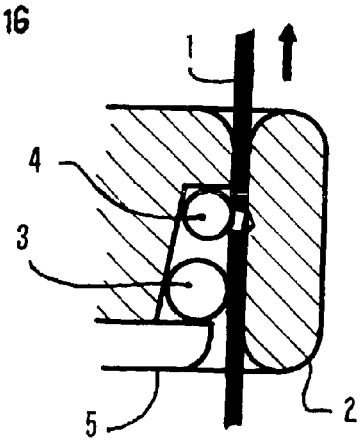
FIG. 2*b* is a detailed sectional view of the locking mechanism in the locking position of a locking boss.

In use, the officer first sets the required size of the loops for surrounding tightly the wrists of a detainee by pulling down the outer sections 15, 16 of the flat strap 1 in the direction of the arrow shown in FIG. 2*a*. Then, by pulling the loops 11, 12 out of the box 2 in the direction of arrow in FIG. 2*b*, the officer ensures that the flat strap 1 is locked within the box 2. Simultaneously, the flat strap 1 moving inside the box carries and rotates the rotational body so that its tip 41 protrudes deeply inside the flat strap 1. Any other effort of the detainee to release the loops by pulling the strap outside the box 2 causes that the tip 41 protrudes deeply into the flat strap 1 till it leans against the supporting wall of the passage 21, 22 whereby the flat strap 1 stands locked in this position. On the other hand, by pulling on the outer sections 15, 16 the loops 11, 12 are further contracted around the detainee's wrists.

Industrial Applicability

The disposable handcuffs according to the present invention are in particular applicable in situations where adverse acts of a number of detainees shall be restrained in a prompt and effective manner by fixing together their hands without the necessity to use other more complicated and time consuming means such as key locking handcuffs, etc.

The invention claimed is:

1. Disposable handcuffs comprising:

a flat strap of flexible material including a central section, two outer sections and two loop sections between said outer sections and said central section;

a box for locking the flat strap therein having a first side, a second side and a pair of passages for receiving the flat strap for longitudinal motion within the passages, the ends of the outer sections extending from the passages on the first side of the box and the loop sections extending from the passages on the second side of the box;

a fixing element able to fix the central section on the box;

each of the passages having a strap supporting wall and an opposite partially offset wall forming a cavity between said walls open to the first side of the box;

a rotational body located within each of the cavities for contact of the rotational surface thereof with the offset wall on one side and the flat strap on the other side;

a boss including a sharp end formed as a tip extending from the rotational surface to engage the flat strap in the area adjacent to the first side of the box and to protrude inside the flat strap to a position where the tip leans against the strap supporting wall; and a cover fixed on the first side of the box and overlapping the cavities.

2. The disposable handcuffs of claim l, wherein a holding down member is disposed between the rotational body and the cover to keep the sharp end of the boss in contact with the flat strap.

3. The disposable handcuffs of claim 2, wherein the holding down member is a roller made of elastic material.

4. The disposable handcuffs of claim 1, wherein each cavity narrows from the first side of the box in that the offset wall is inclined at an angle of 2 to 5 degrees.

5. The disposable handcuffs of claim 1, wherein the box has two central passages in its central part between the passages for fixing the central section of the flat strap in the box.

6. The disposable handcuffs of claim 5, wherein the box has a recess in the central part of the first side for fixedly mounting the cover on the box to secure the central section of the flat strap to the box.

7. The disposable handcuffs of claim 5, wherein the cover has a central edge and two lateral ledges and the first side of the box has complementary surfaces to crimp the flat strap between the central edge and the lateral ledges of the cover and the first side of the box.

8. The disposable handcuffs of claim 1, wherein the flat strap is made of a textile material.

9. Disposable handcuffs comprising:

a flat strap of flexible material including two outer sections, a central section and two loop sections between said outer sections and said central section;

a box having a first side and a second side and a pair of passages each for receiving outer sections of the strap for longitudinal motion within the passages, the ends of the outer sections extending from the first side of the box and the loop sections extending from the second side of the box;

each of the passages having a strap supporting wall and an opposite partially offset wall forming a cavity between said walls open to the first side of the box and narrowing from the first side of the box by inclining the offset wall;

a cover fixed on the first side of the box and overlapping the cavities;

a rotational body located within each of the cavities for contact of the rotational surface thereof with the offset wall on one side and with the flat strap on the other side;

a boss including a sharp end formed as a tip extending from the rotational surface to engage the flat strap in the area adjacent to the first side of the box and to protrude inside the flat strap to a position where the tip leans against the strap supporting wall; and a holding down member located between the rotational body and the cover to keep the sharp end of the boss in contact with the flat strap.

* * * * *